United States Patent [19]

Levine

[11] Patent Number: 4,660,727

[45] Date of Patent: Apr. 28, 1987

[54] MODULAR WINE RACK

[76] Inventor: Steven K. Levine, 130 E. 18th St., New York, N.Y. 10003

[21] Appl. No.: 885,316

[22] Filed: Jul. 14, 1986

Related U.S. Application Data

[63] Continuation of Ser. No. 568,455, Jan. 5, 1984, abandoned.

[51] Int. Cl.[4] ..... A47B 73/00

[52] U.S. Cl. ..... 211/74; 24/545

[58] Field of Search ..... 211/74, 189, 71, 126, 211/183, 60.1, 68, 70.2, 70.8, 70.5, 8; 206/427, 429; 248/313; 220/23.6, 23.4; 24/DIG. 28, 545, 530, 570

[56] References Cited

U.S. PATENT DOCUMENTS

| | | | |
|---|---|---|---|
| D. 51,186 | 8/1917 | Pearson | 24/570 X |
| 236,411 | 8/1875 | Horney | D7/71 |
| D. 252,550 | 8/1979 | Johnson | D6/190 |
| 1,274,306 | 7/1918 | Moisson | 211/70.6 |
| 2,259,667 | 10/1941 | Smith | 211/74 X |
| 2,361,077 | 10/1944 | Albrecht | 211/74 X |
| 2,840,879 | 7/1958 | Boice | 24/570 |
| 2,862,625 | 12/1958 | Norris | 211/74 |
| 3,081,108 | 3/1963 | Vogt | 211/70.2 X |
| 3,673,641 | 7/1972 | Lorber | 24/545 X |
| 3,746,178 | 7/1973 | Wagschal | 211/74 |
| 3,870,155 | 3/1975 | Galloway | 211/74 |
| 4,023,681 | 5/1977 | Plant | 211/74 |
| 4,093,076 | 6/1978 | Newton | 211/74 |
| 4,270,662 | 6/1981 | Gonzalez | 211/74 |

FOREIGN PATENT DOCUMENTS

| | | | |
|---|---|---|---|
| 2501060 | 7/1975 | Fed. Rep. of Germany . | |
| 1467849 | 12/1966 | France | 211/74 |
| 6875 | of 1885 | United Kingdom | 211/74 |
| 20492 | of 1896 | United Kingdom | 211/74 |
| 0015331 | of 1915 | United Kingdom | 24/545 |
| 0386158 | 1/1933 | United Kingdom | 24/570 |
| 0584152 | 1/1947 | United Kingdom | 24/545 |

*Primary Examiner*—Gary L. Smith
*Assistant Examiner*—Sarah A. Lechok Eley
*Attorney, Agent, or Firm*—Blum Kaplan

[57] ABSTRACT

A modular wine rack is provided herewith. The modular wine rack has at least two essentially rigid, undulating, unitary frames. The undulations define peaks at which adjacent frames may be coupled. Spring clips can be used to join the frames into the desired configuration. The frames may be combined in numerous configurations.

23 Claims, 12 Drawing Figures

MODULAR WINE RACK

This is a continuation of application Ser. No. 06/568,455 filed Jan. 5, 1984 now abandoned.

BACKGROUND OF THE INVENTION

The present invention is generally directed to wine racks and, in particular to a modular wine rack. Conventional wine racks have tended to be large and bulky and of prescribed dimensions not necessarily suitable for the users. As a result, modular wine racks were developed which could be constructed from standard components to the desired size by either the retailer or consumer but such constructions tend to be complicated, require numerous parts and the assembled wine racks frequently lack aesthetic appeal. There is a need, however, for a modular wine rack which is quickly expandable in both a horizontal and vertical direction by use of a small number of components, which is simple to assemble, shipable in a compact container and which produces aesthetically pleasing designs.

SUMMARY OF THE INVENTION

Generally speaking, in accordance with the instant invention, a modular wine rack is provided. Each module consists of an undulating frame, formed by a continuous sheet, each undulation being shaped to receive the body of a bottle of wine. The undulations are preferably curved, the shapes of the peaks of the undulations being essentially uniform and lying in common planes. Each end of a frame terminates in an end free essentially lying in one of said planes, each end defining one half of the curve of a peak. Each frame preferably includes at least three peaks. The frames are coupled to each other by clips at at least engaged peaks.

The clips are formed with a base from which two spaced retaining sides project for engaging the spaced surfaces of engaged portions of the frames. Each clip side is curved to correspond to the curve of the frame peaks. One of said sides may include two spaced spring fingers while the other includes a central spring finger.

In a preferred embodiment the frames are substantially sinusoidally shaped with five peaks and are made of a transparent plastic or glass material. The clips and frames may be formed of a transparent plastic material and a clip may be provided for each engaged pair of peaks. A clip is also provided to join pairs of modulus joined end to end, at the engaged ends.

Accordingly, it is an object of the present invention to provide an improved modular wine rack.

Another object of the present invention is to provide an improved modular wine rack which can be easily expanded in both the horizontal and vertical directions.

Still another object of the present invention is to provide a modular wine rack which is aesthetically pleasing in appearance.

A further object of the present invention is to provide a modular wine rack which can be easily assembled in a variety of configurations using a minimum of component types.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in conjunction with the accompanying drawings, in which.

DETAILED DESCRIPTION OF THE PREFERRED EMBODIMENTS

Figure 1:
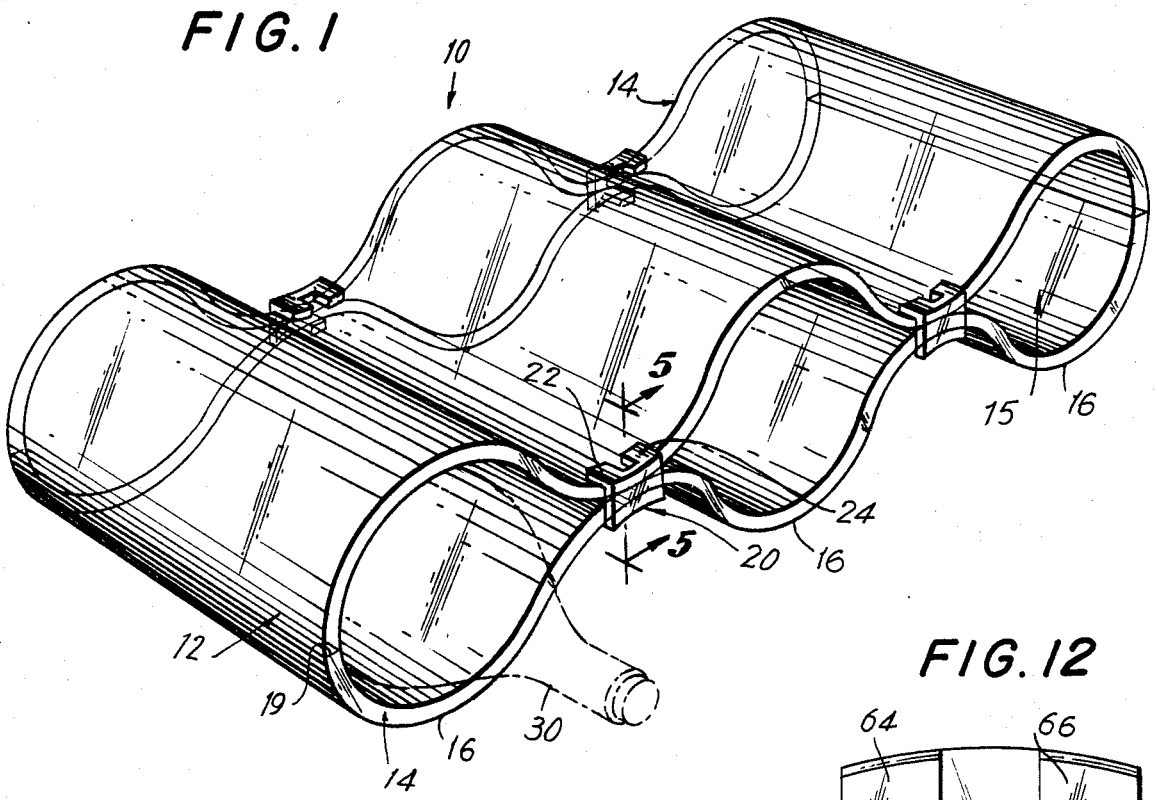
FIG. 1 is a perspective view of a modular wine rack constructed in accordance with a preferred embodiment of the present invention.

Reference is first made to FIGS. 1–8 wherein a modular wine rack section, generally indicated as 10, constructed in accordance with the present invention is depicted. Modular wine rack section 10 is composed of essentially rigid, undulating substantially sinusoidally shaped frames 12 which define the unit module. Frames 12 are of uniform thickness and are formed of a transparent plastic material to define an essentially rigid undulated sheet. Substantially sinusoidal frames 12 have peaks 16 lying in plane 50 (FIG. 2), which in this configuration do not engage an adjacent frame 12 and peaks 18 lying in plane 52 which in this configuration engage the peaks 18 of the adjacent frame 12.

Frames 12 are held together by clips 20 which are adapted to securely fit around engaged peaks 18 on both the front and rear sides 14 of frames 12. When two adjacent frames are attached by clip 20 the ends 19 of frames 12 rest against each other creating the appearance of a smooth continuous surface therebetween. Adjacent frames 12 define substantial openings 15 dimensioned to receive the body of wine bottles. The width of each frame 12 between its front and rear sides 14 is also dimensioned to support the body of a wine bottle 30 (FIG. 1) so that a wine bottle can rest in the upper cavities 17 defined by the peaks 18 of the upper frame 12, in part on the clips 20 therein.

In a preferred embodiment, frames 12 have five peaks 16, 18 so that when two frames 12 are coupled by four clips 20, three openings 15 and two cavities 17 are defined.

Since peaks 10 lie on a single plane 50, the wine rack 10 can rest on any horizontal surface without tipping. Ends 19 lie on the same plane 52 as peaks 18 for mating engagement. The region of each frame adjacent each end 19 defines one-half of a curve essentially identical to the curve defined at each peak 16, 18 so that the same clips 20 can be used to join horizontally alinged pairs of wine rack sections 10 as more particularly shown in FIG. 9. The curve defined by each of peaks or undulations 16, 18 are likewise essentially identical to each other to likewise permit the use of commonly shaped clips 20.

While the frame 12 depicted has three peaks 16 and two peaks 18, by way of example, other frame configurations can be formed, for example, a pair of frames having two peaks 16 and one peak 18 would define two openings 15 and one cavity 17. While frames 12 are shown as formed from a transparent plastic material, an opaque plastic material may be used or other materials such as glass.

Reference is next made to FIGS. 5–8 wherein clip 20, used to couple frames 12 is more particularly depicted. Clip 20 includes a base 21 from which spaced fingers 22 and 24 project on one side and a central finger 26 projects on the other side opposite the space between fingers 22 and 24. Fingers 22 and 24 each have curved inner surface 32 and 34, respectively, shaped to mate with the inner curved surface of a peak 18. Finger 26 has a curved inner surface also shaped to mate with the inner surface 36 of a peak 18 and is curved in a direction opposite from surfaces 32 and 34. In addition to curving outwardly, fingers 22, 24 and 26 also are angled inwardly toward each other from base 21 of clip 2. When two frames 12 are held together by a clip 20, frames 12 force resilient fingers 22, 24 and 26 outwardly at their free ends 42, 44 and 46. Clip 20 is constructed of a material, such as an acrylic or other plastic which deforms but returns to its original shape when the deforming pressure is released. Because fingers 22, 24 and 26 are deformed when clip 20 is urged into place around engaged peaks 18 of frames 12, clip 20 is locked more securely in place. The inwardly directed fingers 22, 24 and 26 act as springs which both serve to hold frames 12 in registration and maintain clip 20 in position. The clips may be formed of an opaque or transparent material.

Figure 5:
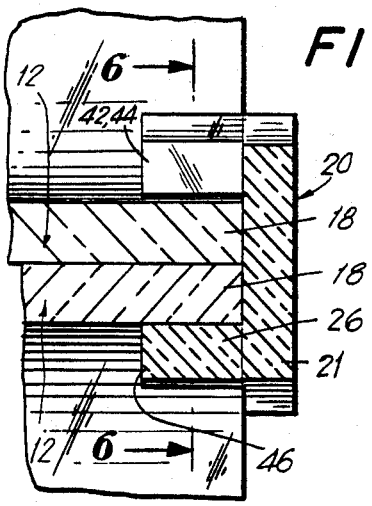
FIG. 5 is a fragmentary enlarged cross-sectional view taken along line 5—5 of FIG. 1.
Figure 6:
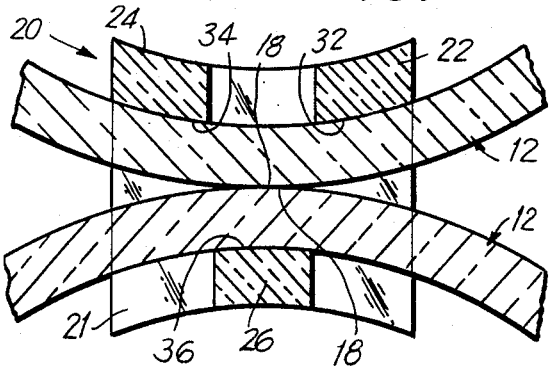
FIG. 6 is a cross-sectional view taken along line 6—6 of FIG. 5.
Figure 7:
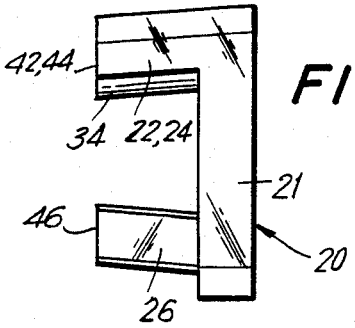
FIG. 7 is a side elevational view of a clip used in a preferred embodiment of the invention.
Figure 8:
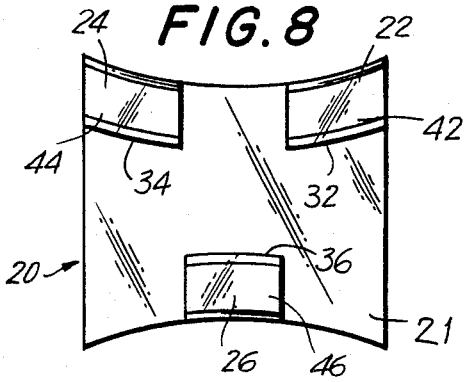
FIG. 8 is a front elevational view of the clip of FIG. 7.

As more particularly shown in FIGS. 5 and 6, wherein the positioning of clip 20 in relation to frames 12 is depicted, fingers 22, 24 and 26 are deformable so that the spacing of finger 26 from fingers 22 and 24 is twice the thickness of frames 12. It can also be seen that the interior faces 32, 34 and 36 are adapted to engage the correspondingly curved surfaces of frames 12 at peaks 18.

Figure 2:
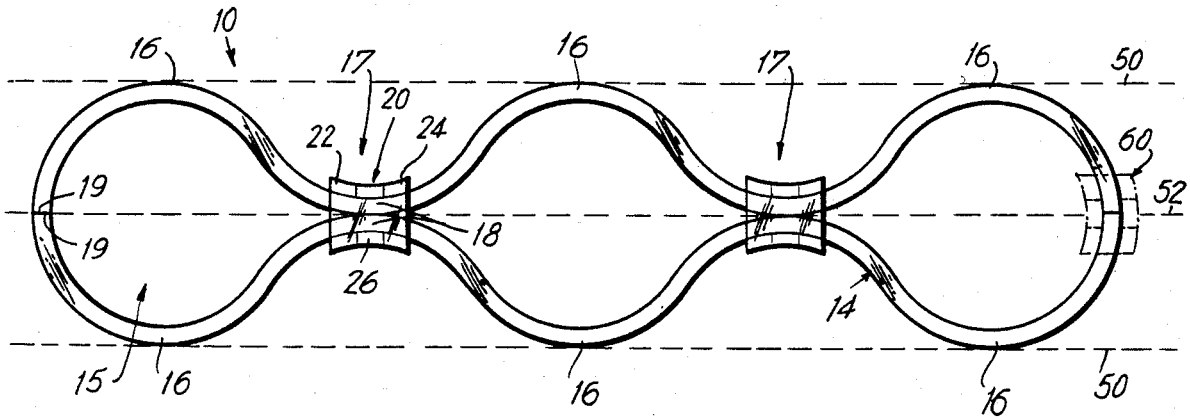
FIG. 2 is a front elevational view of the modular wine rack of FIG. 1 with an optional end clip shown in phantom lines in accordance with the invention.
Figure 3:
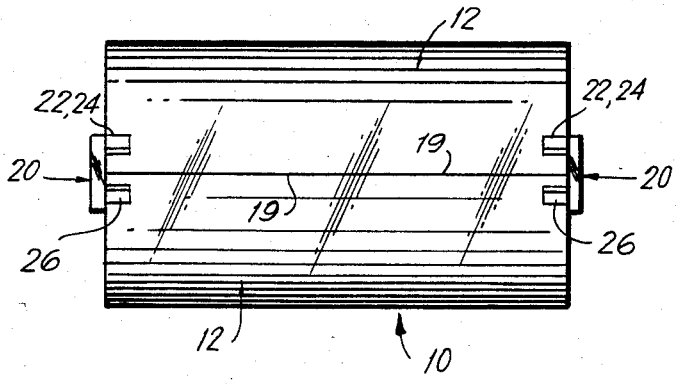
FIG. 3 is an end elevational view of the modular wine rack of FIG. 1.

As more particularly shown in FIGS. 2 and 3, the opposed ends 19 of frames 12 form in a continuous curve which is pleasing to the eye and defines an essentially smooth outer surface.

Figure 4:
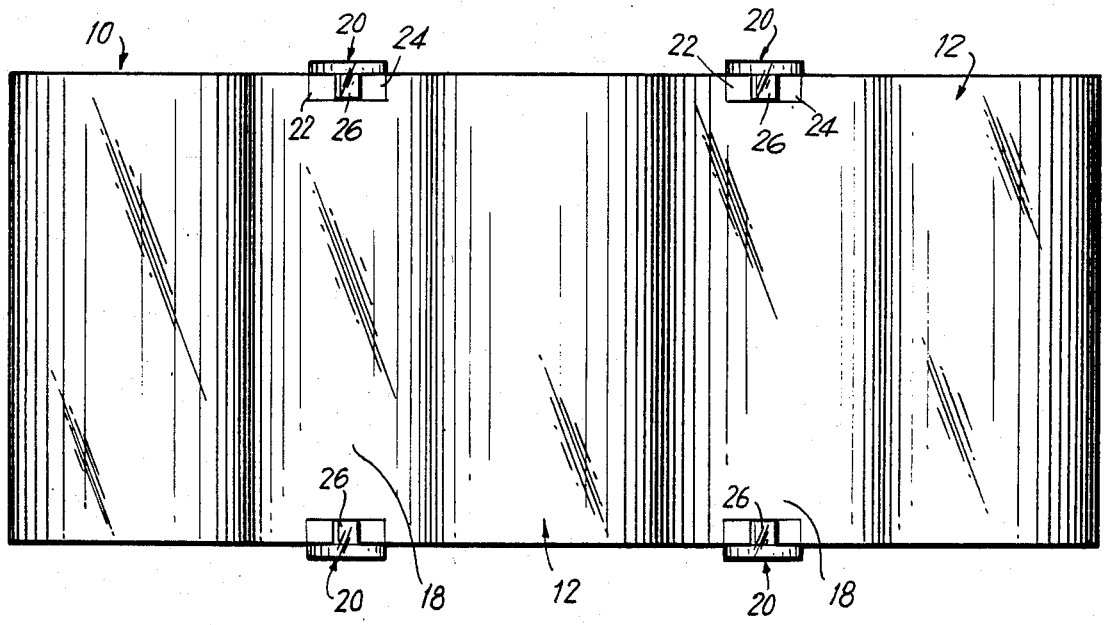
FIG. 4 is a bottom plan view of the modular wine rack of FIG. 1.

As shown in FIGS. 1 and 4, four clips 20 are used to secure the two frames 12 together, two at each side 14 of each engaged pair of peaks 18.

Figure 12:
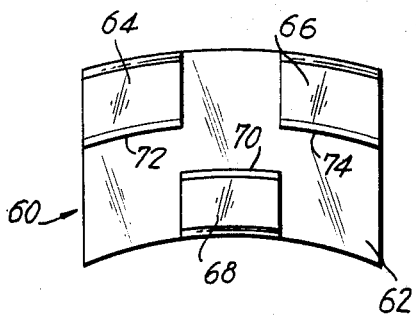
FIG. 12 is a front elevational view of the optional side clip shown in phantom in FIG. 2.

Referring to FIGS. 2 and 12, an optional additional form of clip 60 may be used to join ends 19 together. Clip 60 is provided with a base 62 from which a pair of spaced, inwardly inclined fingers 64 and 66 project on one side and a single central finger 68 projects from the other side. Finger 68 is positioned opposite the space between fingers 64 and 66 and is formed with a curved surface 70 corresponding to the curvature of the inner surface of end 19. Fingers 64 and 66 are formed with curved surfaces 72 and 74, respectively, which correspond to the curvature of the outer surface of ends 19 so that the curvature of surface 70 is essentially parallel to the curvature of surfaces 72 and 74. Fingers 64 and 66 are spaced from finger 68 so that, when spread by the insertion of joined ends 19 of two frames 12, their separation equals the thickness of frame 12. Four optional clips 60 would be used, two on each side 14 of each pair of formed ends 19.

Figure 9:
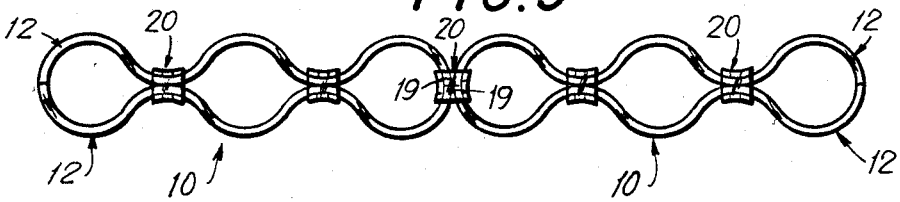
FIG. 9 is front elevational view of a horizontal expansion of a modular wine rack in accordance with the invention.
Figure 10:
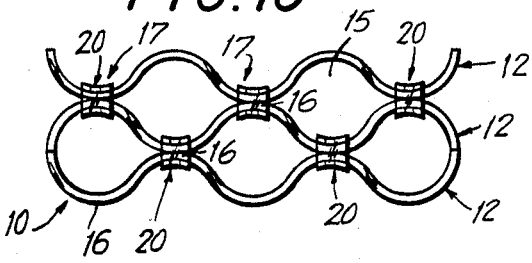
FIG. 10 is a front elevational view of another configuration of a modular wine rack in accordance with the invention.
Figure 11:
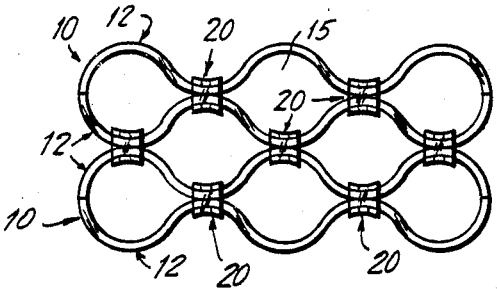
FIG. 11 is a front elevational view of yet another embodiment of a modular wine rack in accordance with the invention.

Reference is next made to FIGS. 9, 10 and 11 wherein alternate configurations of modular wine racks constructed in accordance with the invention are depicted. In FIG. 9, a wine rack formed of two wine rack sections 10 aligned in end-to-end relation is joined at said ends by two clips 20, one on each side 14 of joined ends 19. In FIG. 10 a single frame 12 is joined to a wine rack section 10 by engaging peaks 16 thereof and joining these engaged peaks by six clips 20, one on each side 14 of each engaged pair of peaks 16. This arrangement defines five openings 15 and three cavities 17 when the extra frame 12 is on top. However, the arrangement of FIG. 10 can be inverted with the extra frame 12 on the bottom. In the embodiment of FIG. 11, two wine rack sections 10 are joined vertically by six clips 20 at engaged peaks 16, one clip at each side 14 of each engaged pair of peaks. There is no restriction on the number of frames 12 in a modular wine rack constructed in accordance with the invention except the strength of the materials.

Clips 20 can be removed by pulling them outward from the connection points. Once they are removed, the frames 12 can be reattached in the same or different positions. This flexibility is desirable because it allows for the reconfiguration of a wine rack to more particularly satisfy varying needs. Additionally, frames 12 can be nested within one another for compact shipping and storage. The assembled wine racks in accordance with the invention are aesthetically pleasing and highly functional.

While the undulating frames 12 are shown having an essentially sinusoidally curved shape, other curvatures for the undulations can be used. For example, an essentially saw-tooth shape, or a saw-tooth having a flattened peak may be used, the clips being shaped to conform to the opposed, engaged peaks. The resultant wine rack would give the appearance of a series of diamond shaped openings and V-shaped cavities. The ends of each frame would preferably be shaped to conform to the shape of the peaks.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A modular wine rack comprising at least two frame members, each frame member being formed of an essentially rigid, undulated, unitary member, said undulations being shaped to define peaks in each frame member, the two frames having engaged peaks and spaced peaks, the distance between the spaced peaks being dimensioned to receive a wine bottle; and coupling means for securing said frames together at respective engaged peaks thereof, said coupling means including readily removable clip means securing said frames together at respective engaged peaks, said clip means having a shape in the lateral direction corresponding to the undulations of said coupled frames proximate said engaged peaks.

2. A modular wine rack as claimed in claim 1, wherein the peaks defined by the undulations of each frame member lie in two spaced essentially parallel planes.

3. A modular wine rack as claimed in claim 2, wherein the shapes of the peaks defined by the undulations are essentially uniform.

4. A modular wine rack as claimed in claim 3, wherein at least one end of each frame terminates in an edge essentially lying in one of said planes for mating in abutting relation with a corresponding edge of an end of another of said frame members.

5. A modular wine rack as claimed in claim 4, wherein said at least one end of each frame member defines one-half of a shape essentially identical to the shape of said peaks, whereby the abutting ends of two frame members define said shape.

6. A modular wine rack as claimed in claim 4, wherein both ends of each frame member terminate in an edge lying on the same one of said planes, and whereby both ends of a pair of joined frame members mate in abutting relation to each to define a wine bottle-receiving opening with an adjacent peak of each frame member.

7. A modular wine rack as claimed in claim 6, wherein each end of each frame member defines one-half of a shape essentially identical to the curve of said peaks, whereby abutting ends of two frame members define said curve.

8. A modular wine rack as claimed in claim 7, wherein each frame member includes at least three peaks.

9. A modular wine rack as claimed in claim 7, including at least two frame members each having five peaks, said coupling means securing said two frame members together with abutting end edges and two pairs of engaged peaks.

10. A modular wine rack as claimed in claim 9, wherein said coupling means includes four clip members, two clip members joining each engaged pair of peaks, one on each side of each peak.

11. A modular wine rack as claimed in claim 1, wherein a clip member engages each side of an engaged pair of peaks.

12. A modular wine rack as claimed in claim 1, wherein each clip member has a base and opposed sides projecting therefrom spaced to receive the thickness of two frame members therebetween.

13. A modular wine rack as claimed in claim 12, wherein at least one of the opposed projecting sides of each clip member is resilient and normally spaced from the other side before mounting a distance less than the thickness of two frame members.

14. A modular wine rack as claimed in claim 13, wherein one of said opposed projecting sides of each clip is formed of a pair of spaced fingers and the other of said opposed projecting sides is formed of a further finger positioned opposite to the space between said first-mentioned fingers; at least one of said first mentioned fingers and further fingers being resilient and inclined toward the other side from said base.

15. A modular wine rack as claimed in claim 13, wherein the respective inner surfaces of said projecting sides of each clip member are oppositely curved to mate with the inner surfaces of the engaged peaks.

16. A modular wine rack as claimed in claim 7, including at least two pairs of coupled frame members, the respective ends of the frame members of each pair abutting with each other, said coupled pair of frame members being joined in side-by-side relation with the abutting ends of one pair engaging the abutting ends of the other pair, said coupling means including clip members joining pairs of engaged peaks at at least one side of the pairs of engaged peaks, at least one further of said clip members joining the engaged abutting ends of the pairs of frame members at a side thereof.

17. A modular wine rack as claimed in claim 16, wherein each of said clip members has a base and opposed sides projecting therefrom spaced to receive the thickness of two frames members therebetween.

18. A modular wine rack as claimed in claim 17, wherein the respective surfaces of said projecting sides of each clip member are reciprocally shaped to mate with the curved inner surfaces of the engaged peaks or abutting ends.

19. A modular wine rack as claimed in claim 6, including at least three said frame members, said coupling means joining two of said frame members with abutting ends and the third of said frame members with the peaks thereof in engagement with the peaks of one of the other two frame members and the ends of said third frame member facing away from said other two frame members.

20. A modular wine rack as claimed in claim 1, wherein said frame members are formed of a transparent material.

21. A modular wine rack as claimed in claim 1, wherein said frame members are formed of plastic.

22. A modular wine rack as claimed in claim 4, wherein the shape of said peaks is a continuous curve.

23. A modular wine rack as claimed in claim 1, wherein the unitary member is a sheet.

* * * * *